US007351923B2

(12) United States Patent
Barthelet et al.

(10) Patent No.: US 7,351,923 B2
(45) Date of Patent: Apr. 1, 2008

(54) PORTABLE COMMUNICATION DEVICE WITH SWIVELING KEY

(75) Inventors: Philippe Barthelet, Boise-Colombes (FR); Christophe Thullier, Montigny le Bretonneux (FR); Sylvain Gautier, Eragny sur Oise (FR)

(73) Assignee: TCL & Alcatel Mobile Phones Limited, Kowloon (HK)

( * ) Notice: Subject to any disclaimer, the term of this patent is extended or adjusted under 35 U.S.C. 154(b) by 13 days.

(21) Appl. No.: 11/365,765

(22) Filed: Feb. 28, 2006

(65) Prior Publication Data

US 2006/0283692 A1 Dec. 21, 2006

(30) Foreign Application Priority Data

Mar. 31, 2005 (EP) ..... 05300235

(51) Int. Cl.
*H01H 25/04* (2006.01)

(52) U.S. Cl. ..... 200/6 A; 341/20; 345/161

(58) Field of Classification Search ..... 200/4, 200/5 R, 14, 6 A, 17 R, 18, 329, 339, 553; 341/20, 22; 345/165, 157, 160, 161, 168, 345/169, 184

See application file for complete search history.

(56) References Cited

U.S. PATENT DOCUMENTS 4,127,752 A 11/1978 Lowthorp ..... 200/5 A
4,289,943 A 9/1981 Sado ..... 200/159 B
4,920,238 A * 4/1990 Aso ..... 200/6 R
5,283,401 A 2/1994 Schmucker ..... 200/6
6,037,552 A * 3/2000 Yamada ..... 200/339
6,115,030 A * 9/2000 Berstis et al. ..... 345/161
6,613,990 B2 * 9/2003 Kawasaki ..... 200/6 A
7,060,915 B2 * 6/2006 Bricaud et al. ..... 200/5 R
7,094,979 B2 * 8/2006 Kurokawa et al. ..... 200/5 R
7,094,983 B2 * 8/2006 Tsunemoto ..... 200/339

FOREIGN PATENT DOCUMENTS

DE 19746843 10/1997

OTHER PUBLICATIONS

European Search Report—Sep. 13, 2005.

* cited by examiner

*Primary Examiner*—Michael A Friedhofer
(74) *Attorney, Agent, or Firm*—Morgan, Lewis & Bockius LLP

(57) ABSTRACT

A portable communication device with an external housing (1) containsat least a mechanical switch (2*a;* 2*b*) and at least one key (3) for actuation of said mechanical switch (2*a;* 2*b*), said key comprising an actuation surface (30) which protrudes from said external housing through an aperture (10), and the mechanical switch being able to be actuated by swiveling of the key (3) around an axis (XX') substantially perpendicular to said actuation surface. According to the invention said key is made of plastic material and comprises, in its thickness and behind said actuation surface, at least one emerging slit (31*a;* 31*b*) extending substantially parallel to said actuation surface.

3 Claims, 1 Drawing Sheet

PORTABLE COMMUNICATION DEVICE WITH SWIVELING KEY

RELATED APPLICATION

This application is related to and claims the benefit of priority from European Patent Application NO. 05 300 235.8, filed on Mar. 31, 2005, the entirety of which is incorporated herein by reference.

FIELD OF THE INVENTION

The present invention concerns a new key for use in any type of portable communication device such as mobile handset, Personal Digital Assistant, organizes or other small devices for which bulk constraints are generally high. More precisely, the invention relates to the design of a swiveling key which enables protection of the internal components in case of impacts or shocks.

BACKGROUND OF THE INVENTION

The use of a swiveling key for actuation of one ore several mechanical switches located inside the external housing of a portable device is already known. This key generally comprises an actuation surface for manual actuation by a user. The mechanical switches can be actuated by swiveling the key around at least an axis which is substantially perpendicular to the actuation surface of the key. This means that the mechanical switches must be located behind the key, while being eccentric with respect to said axis.

In order to provide a good ergonomic use, the actuation surface preferentially protrudes from the external housing. However, this means also that the key is much more exposed to external constraints, especially to shocks. In case of big shocks, for instance if the communication device falls down, the key may strongly swivels, and this can cause damages on the mechanical switch which is behind the key.

Several solutions have been proposed in order to protect the mechanical switch:

A first solution consists in providing a key made of rubber in order that the key can absorb shocks. However, in this case, the tactile feeling for a user is not sufficient. In addition, the finishing of a rubber key is limited. This solution does not enable to have a large choice of esthetic aspects for the final key (plating, paint, steal, transparent . . . )

Another known solution enabling the use of a plastic key consists in providing a silicon layer inside the housing, between the key and the mechanical switch. This solution is good for the tactile effect and enables a large variety of finishing. However, it is a very costly solution in term of added material, and also of assembly.

OBJECTS AND SUMMARY OF THE INVENTION

The aim of the invention is to remedy the above drawbacks by proposing an economic solution enabling the use of a plastic key, with the advantages of a good tactile feeling and various finishing, while having a good protection of the mechanical switch in case of strong shocks.

To this aim, an object of the present invention is a portable communication device with an external housing containing at least a mechanical switch and at least one key for actuation of said mechanical switch, said key comprising an actuation surface (which protrudes from said external housing through an aperture, and the mechanical switch being able to be actuated by swiveling of the key around an axis substantially perpendicular to said actuation surface, characterized in that said key is made of plastic material and comprises, in its thickness and behind said actuation surface, at least one emerging slit extending substantially parallel to said actuation surface.

BRIEF DESCRIPTION OF THE DRAWINGS

Other features and advantages of the invention will become apparent from the following description of one possible preferred embodiment of the invention, given by way of non-limiting example only, and with reference to the accompanying drawings, in which.

DETAILED DESCRIPTION

Figure 1:
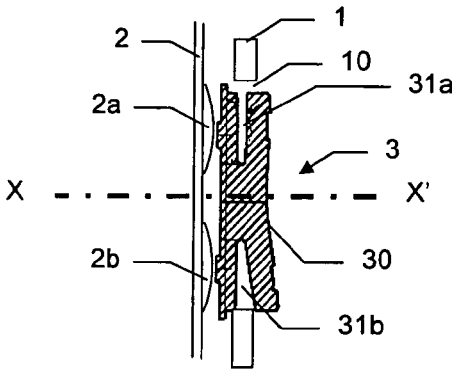
FIG. 1 shows schematically a partial cross-section of a device equipped with a key in accordance with the invention, in a rest position.
Figure 2:
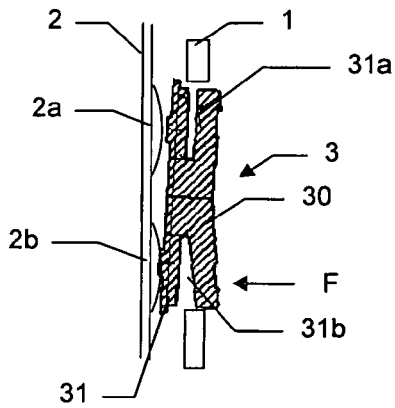
FIG. 2 shows the same view as above, while normal actuation of the key is made.
Figure 3:
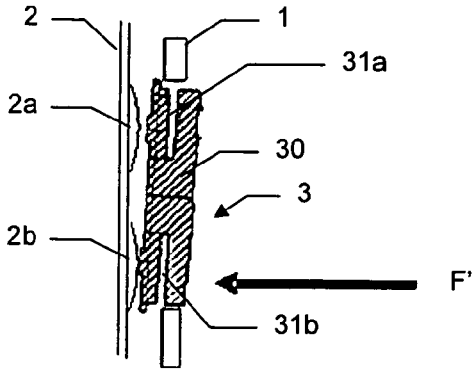
FIG. 3 shows the same the same view as above, in case of big external shock on the key.

In FIGS. 1 to 3, reference 1 indicates part of a wall of an external housing of a portable communication device (for instance the lateral wall of a mobile phone casing), references 2*a*, 2*b* indicate two mechanical switches inside said housing, and reference 3 designates a swiveling key enabling the actuation of one of the mechanical switches. Mechanical switches 2*a* and 2*b* may be supported by the same PCB 2. Key 3 lies through an aperture 10 in the housing and comprises an actuation surface 30. As can be seen from FIG. 1, said actuation surface 30 protrudes from said external housing when the key is in its rest position. This advantageously enables a good ergonomic use. In order for the user to activate either switch 2*a* or switch 2*b*, key 3 can swivel around axis XX' (FIG. 1). Mechanical switches 2*a*, 2*b* are eccentric with respect to said axis. In the rest position shown in FIG. 1, key 3 is in contact with none of the mechanical switches. If the user presses key 3, for instance on the lowest area as indicated by array F on FIG. 2, key 3 swivels around axis XX' until one extremity 31 of the key side opposite to actuation surface 30 reaches a metallic dome of mechanical switch 2*b*. Under pressure, this metallic dome will be resiliently deformed until activation of the switch. Other kind of mechanical switches can also be used. Key 3 is made of plastic (thus rigid) material. This enables several possibilities of finishing, including painting, plating . . .

According to an essential feature of the invention, said key comprises also slits 31*a*, 31*b* in the thickness of the key, said slits extending substantially parallel to actuation surface 30. The aim of these slits (the number of which should correspond to the number of mechanical switches which can be actuated by the same key) is to absorb a shock in order to prevent the mechanical switch from being deteriorated. The shape and size of each slit 31*a*, 31*b* is a compromise to make between, on one hand, the necessity to have a good global rigidity of the key in order to have no impact on the click feeling, and, on the other hand, the necessity to have enough deformation in order to absorb shocks. The position of the slits inside the thickness of the key also depends on the general shape of the key. However, the slits must be located behind the actuation surface 30. As we can see from the drawings, slits are emerging on aperture 10. Parts of the actuation surface which face directly the slits have thus, despite the rigidity of plastic, some elasticity. When the key is in its rest position, the slits extend preferably in the plane of aperture 10, and sets back from the external surface of wall 1 of the external housing, as can be seen from FIG. 1. Consequently, slits are advantageously not visible from the exterior. In case of a big constraint due to a shock, as materialized by arrow F' on FIG. 3, slit 31*b* has been designed in order to enable a deformation of the key until the corresponding area of the activation surface becomes flush with external housing 1, as shown on FIG. 3. When it comes in this position, most of the shock has been absorbed, preventing the mechanical switch from being deteriorated.

The present invention can be applied for any type of portable device, for which the risk of shocks is high, and whatever the position of the key with respect to the external housing of the device. For instance, in the case of a mobile handset, the key may be a lateral key, or any key located at the front side or the rear side of the mobile handset. In addition, although a key which may swivel around an axis is preferably used in order to activate two mechanical switches, the invention can also apply for the case of a single mechanical switch. Moreover, a man skilled in the art will easily adapt the principle of the invention to a key which may swivel around several axes, enabling the actuation of more than two mechanical switches.

The invention claimed is:

1. A portable communication device comprising:

an external housing containing at least a mechanical switch and at least one key for actuation of said at least a mechanical switch, said at least one key having an actuation surface which protrudes from said external housing through an aperture, and the at least a mechanical switch being able to be actuated by swiveling of the at least one key around an axis substantially perpendicular to said actuation surface, wherein said at least one key is made of plastic material and includes, in a thickness and behind said actuation surface, at least one emerging slit extending substantially parallel to said actuation surface wherein said at least one emerging slit is designed in order to enable a deformation of the at least one key until a corresponding area of the activation surface becomes flush with the external housing.

2. A portable communication device according to claim 1, wherein, when the at least one key is in a rest position, said at least one emerging slit extends preferably in a plane of aperture, and sets back from the external housing.

3. A portable communication device according to claim 1, wherein said at least one key stands on a lateral wall of said external housing.

* * * * *